US006062647A

United States Patent [19]

Mei

[11] Patent Number: 6,062,647

[45] Date of Patent: May 16, 2000

[54] ADJUSTABLE ARMREST ASSEMBLY

[76] Inventor: Teng-Fu Mei, P.O. Box 63-247, Taichung, Taiwan

[21] Appl. No.: 09/366,057

[22] Filed: Aug. 2, 1999

[30] Foreign Application Priority Data

Jul. 8, 1999 [TW] Taiwan ..... 88 11 77

[51] Int. Cl.[7] ..... A47C 7/54

[52] U.S. Cl. ..... 297/411.36; 297/353

[58] Field of Search ..... 297/411.36, 353, 297/411.31, 411.35

[56] References Cited

U.S. PATENT DOCUMENTS

| | | | |
|---|---|---|---|
| 4,221,430 | 9/1980 | Frobose | 297/353 |
| 4,639,039 | 1/1987 | Donovan | 297/353 |
| 4,660,885 | 4/1987 | Suhr et al. | 297/353 |
| 4,749,230 | 6/1988 | Tornero | 297/353 |
| 5,037,158 | 8/1991 | Crawford | 297/353 |
| 5,232,265 | 8/1993 | Estkowski et al. | 297/353 |
| 5,318,347 | 6/1994 | Tseng | 297/411.36 |
| 5,324,096 | 6/1994 | Schultz | 297/411.36 |
| 5,551,754 | 9/1996 | Neumueller | 297/353 |
| 5,582,460 | 12/1996 | Schultz | 297/353 |
| 5,586,811 | 12/1996 | Tornero | 297/411.36 |
| 5,588,766 | 12/1996 | Lai | 297/411.36 X |
| 5,597,204 | 1/1997 | Karaus, Jr. | 297/353 |
| 5,649,741 | 7/1997 | Beggs | 297/353 |
| 5,664,842 | 9/1997 | Tseng | 297/411.36 |
| 5,695,249 | 12/1997 | Lotfi | 297/353 |
| 5,725,278 | 3/1998 | Verbeek | 297/353 |
| 5,735,577 | 4/1998 | Lin | 297/411.36 |
| 5,879,054 | 3/1999 | Cao | 297/353 X |
| 5,882,078 | 3/1999 | Gebhard | 297/353 |
| 5,951,107 | 9/1999 | Tornero | 297/353 |

*Primary Examiner*—Peter M. Cuomo
*Assistant Examiner*—Rodney B. White
*Attorney, Agent, or Firm*—Alan Kamrath; Oppenheimer Wolff & Donnelly LLP

[57] ABSTRACT

An adjustable armrest assembly includes an armrest main body having a compartment therein. A positioning member has an end slidably received in the compartment. The end of the positioning member includes a vertical slot consisting of a number of consecutively connected vertical retaining holes. Two adjacent retaining holes have a reduced neck portion therebetween. A locking member has a relatively larger section and a relatively smaller section. The relatively larger section of the locking member is normally biased to engage with one of the retaining holes. When an operative member integral with the locking member is manually operated, the relatively larger section of the locking member is disengaged from the retaining hole, and the relatively smaller section is moved to engage with the vertical slot.

17 Claims, 8 Drawing Sheets

ADJUSTABLE ARMREST ASSEMBLY

BACKGROUND OF THE INVENTION

1. Field of the Invention

The present invention relates to an adjustable armrest assembly for a chair or the like.

2. Description of the Related Art

FIGS. 7 through 9 of the drawings illustrates a conventional adjustable armrest assembly that is adjustable in height to suit different users. The adjustable armrest includes a main body 8' with a cruciform slot 81' for securely engaging with two pins 7'. A plate 61' with a number of continuously formed retaining holes 6' is mounted in the main body 8' for releasably engaging with the pins 7'. The plate 61' is securely attached to a chair seat (not shown) or the like. A cover plate 9' is attached to the main body 8' for enclosing the plate 61'. An actuating member 5' is mounted to the main body 8' with a manual operative piece 53' exposed outside via an opening 92' of the cover plate 9'. A spring 91' is attached to an upper end of an actuating rod 51' of the actuating member 5'. The actuating rod 51' is releasably positioned between the pins 7' under the manual operation of the operative piece 53' for controlling adjustment of the armrest.

It is, however, found that the pins 7' tend to undesirably disengage from the retaining holes 6'. In addition, the engaging effect between the pins 7' and the retaining holes 6' is not reliable such that the armrest cannot be reliably retained at the desired height.

The present invention is intended to provide an improved adjustable armrest that mitigates and/or obviate the above problems.

SUMMARY OF THE INVENTION

It is a primary object of the present invention to provide an improved adjustable armrest that is simple in structure to allow quick assembly.

It is another object of the present invention to provide an improved adjustable armrest that can be retained at the desired level after adjustment.

An adjustable armrest assembly in accordance with the present invention comprises:

an armrest main body having a compartment therein;

a positioning member having an end slidably received in the compartment, the end of the positioning member including a vertical slot; and a locking means pivotally connected to the armrest main body, the locking means including an operative member exposed outside the armrest main body for manual operation, the locking means being releasably engaged in the vertical groove for retaining the positioning member in a desired level.

The vertical slot includes a plurality of consecutively connected vertical retaining holes. Two adjacent retaining holes have a reduced neck portion therebetween. The locking means includes a locking member having a relatively larger section and a relatively smaller section. The relatively larger section is larger than the reduced neck portion and sized to be received in one of the retaining holes. The relatively smaller section is sized to be passable through the reduced neck portion.

An elastic member has a first end attached to the locking means and a second end attached to the armrest main body for biasing the relatively larger section of the locking member to engage with one of the retaining holes, thereby retaining the armrest main body at a desired level relative to the positioning member.

The armrest main body includes a vertical groove on each of two lateral walls thereof for slidably holding the end of the positioning member.

In an embodiment of the invention, a top plate is secured on top of the armrest main body, and the locking means is in pivotal connection with the top plate such that the locking means is moved to disengage from the vertical slot when the operative member is manually operated.

The locking means includes a transverse hole through which a screw extends, thereby providing a pivotal connection with the locking means and the top plate, and wherein the locking means includes a recessed section communicated with the transverse hole. The elastic member is V-shape with a bend section and received in the recessed section of the locking means, the screw being extended below the bend section of the elastic member.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
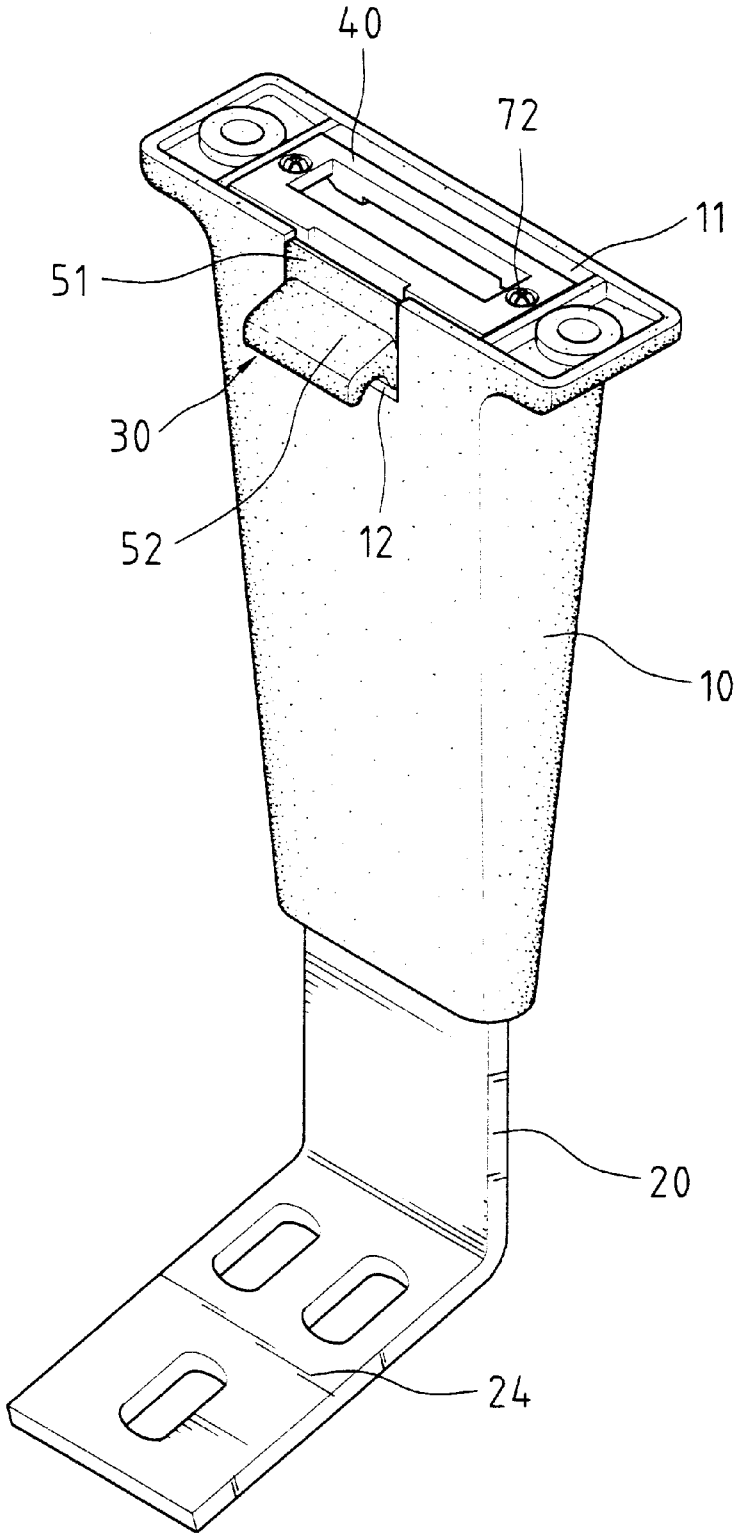
FIG. 1 is a perspective view of an adjustable armrest in accordance with the present invention.
Figure 2:
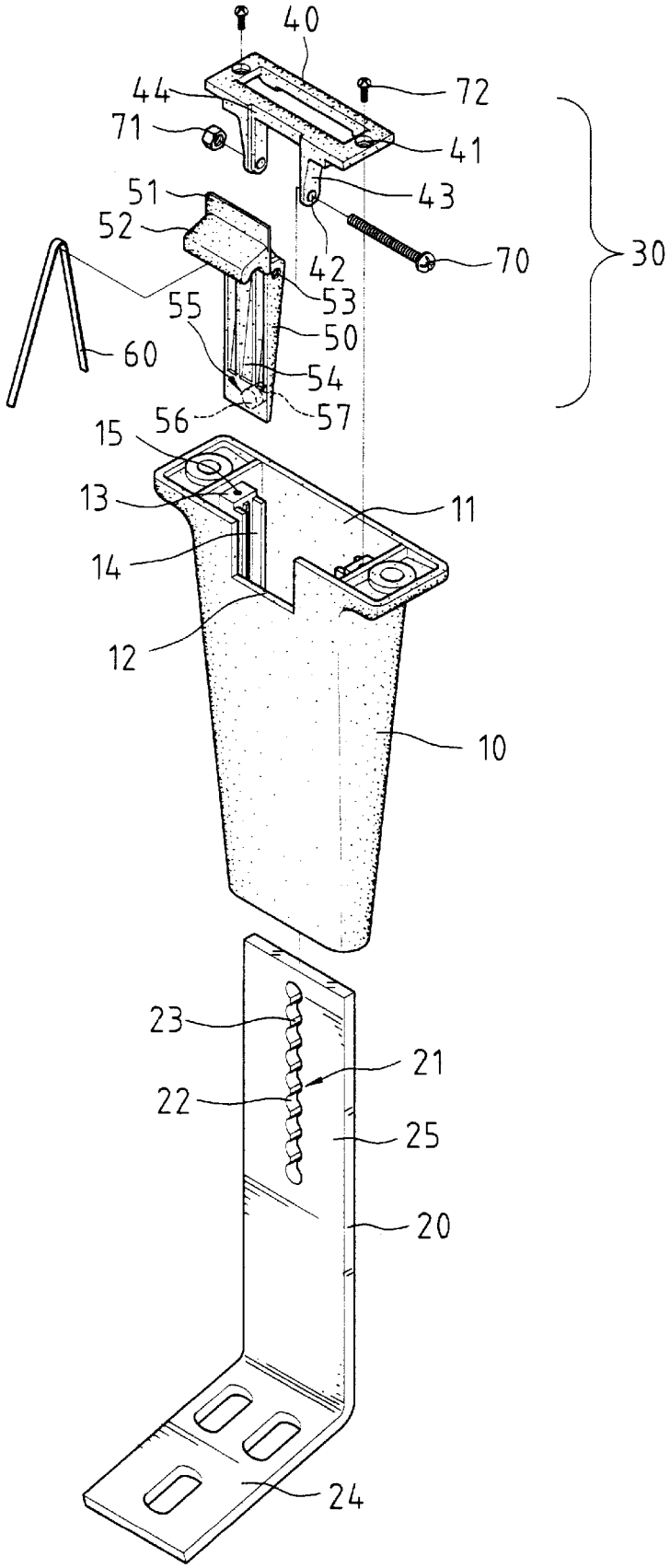
FIG. 2 is an exploded perspective view of an adjustable armrest in accordance with the present invention.

Referring to FIGS. 1 through 6 and initially to FIGS. 1 and 2, an adjustable armrest assembly in accordance with the present invention generally includes an armrest main body 10 having a compartment 11 defined therein. A slot 12 is defined in a front or rear wall of the armrest main body 10 and communicated with the compartment 11. Each of two opposite lateral walls that defines the compartment 11 includes a positioning section 13 with a screw hole 15 in an upper end thereof. Each positioning section 13 further includes a vertical groove 14 defined in a side thereof.

A positioning member 20 includes a first end 24 secured to a chair seat (not shown) and a second end 25 in sliding engagement with the grooves 14 of the positioning sections 13. The second end 25 of the positioning member 20 includes a vertical slot 21 consisting of a plurality of consecutively connected vertical retaining holes 22. Each two adjacent retaining holes 22 have a reduced neck portion 23 therebetween.

A locking device 30 is mounted in the armrest main body 10 and includes a top plate 40 and a locking means 50. The top plate 40 includes a screw hole 41 in each end thereof. A screw 72 is extended through each screw hole 41 and the screw hole 15 in the associated positioning section 13. The top plate 40 further includes a pair of spaced lugs 43 with aligned holes 42. A pin or screw 70 is extended through the holes 42 of the lugs 43 and a transverse hole 53 in the locking means 50 and a nut 71 is engaged to the screw 70. Thus, the locking means 50 is pivotally connected to the top plate 40.

Figure 3:
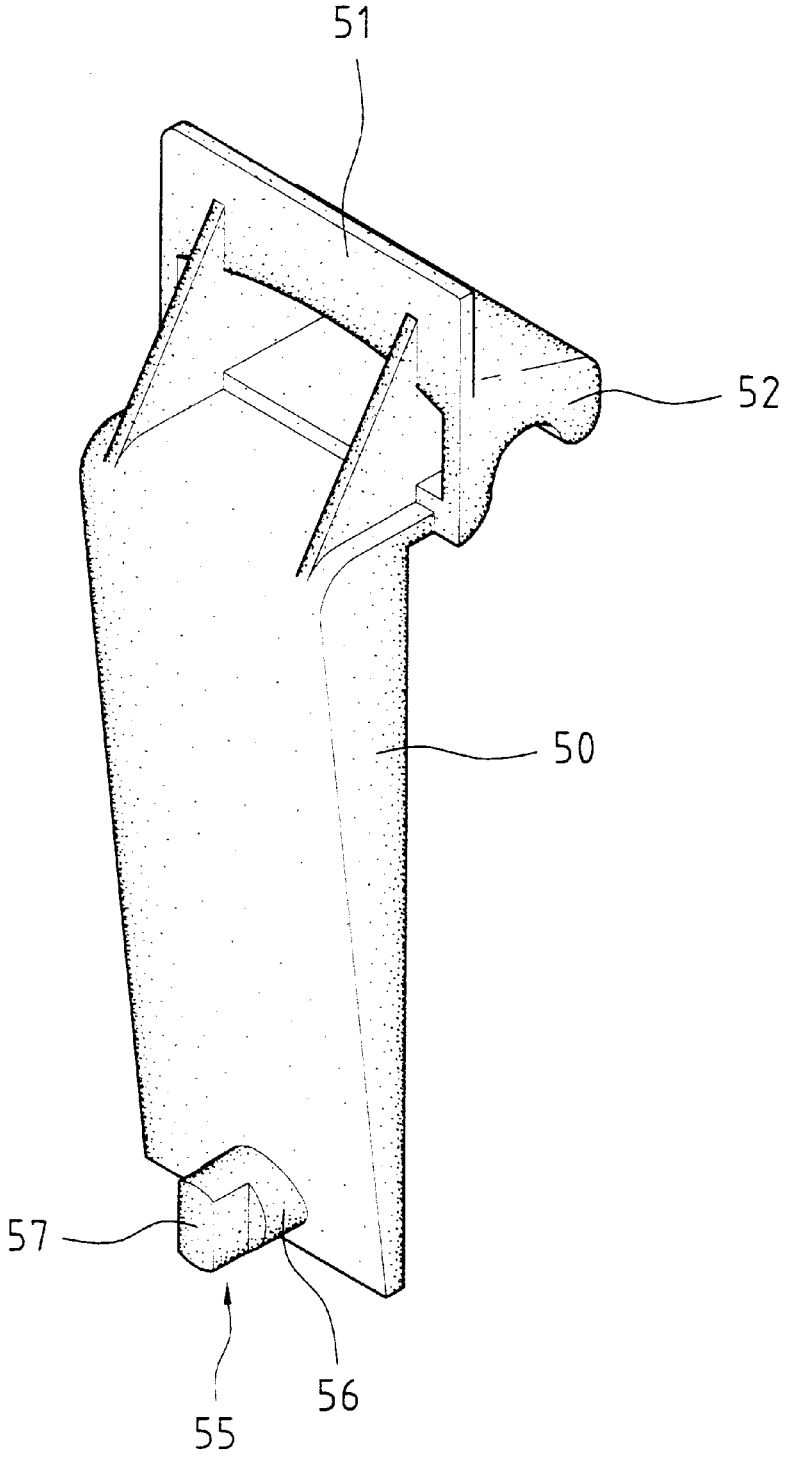
FIG. 3 is a rear perspective view, at an enlarged scale, of a locking means of the adjustable armrest in accordance with the present invention.
Figure 4:
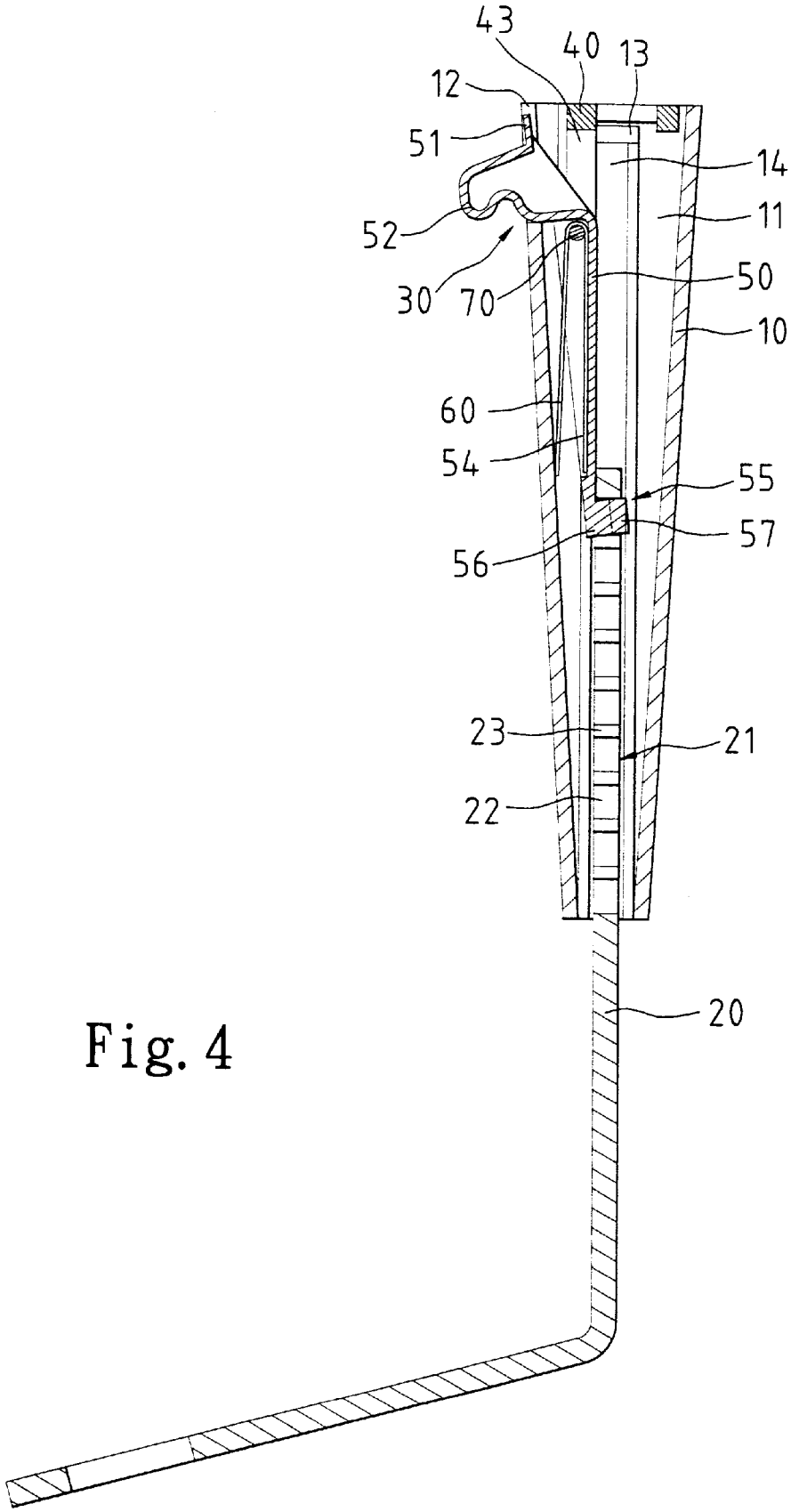
FIG. 4 is a sectional view of the adjustable armrest in accordance with the present invention, wherein the locking means is in an engaged position.

The locking means 50 includes a vertical stop 51 formed on an upper end thereof, the vertical stop 51 abuts against a vertical wall 44 (FIG. 2) of the top plate 40. The locking means 50 further includes a recessed section 54 that communicates with the transverse hole 53. A substantially V-shaped elastic member 60 is mounted in the recessed section 54. As illustrated in FIG. 4, the screw 70 extends below a bend section of the elastic member 60. An end of the elastic member 60 bears against the locking means 50 and the other end of the elastic member 60 bears against a wall of the armrest main body 10. The locking means 50 further includes an operative member 52 that extends beyond the slot 12 of the armrest main body 10 for manual operation. Referring to FIG. 3, the locking means 50 further includes a locking member 55 having a relatively larger section 56 and a relatively smaller section 57. The relatively larger section 56 is larger than the reduced neck portion 23 and sized to be received in the retaining hole 22. The relatively smaller section 57 is sized to be passable through the reduced neck portion 23.

FIG. 4 illustrates a sectional view of the armrest assembly, wherein the relatively larger section 56 of the locking means 50 securely engages with one of the retaining holes 22 under the action of the elastic member 60, thereby retaining the armrest main body 10 at a level relative to the positioning member 20. This is because the relatively larger section 56 is not allowed to pass through the reduced neck portions 23 of the positioning member 20.

Figure 5:
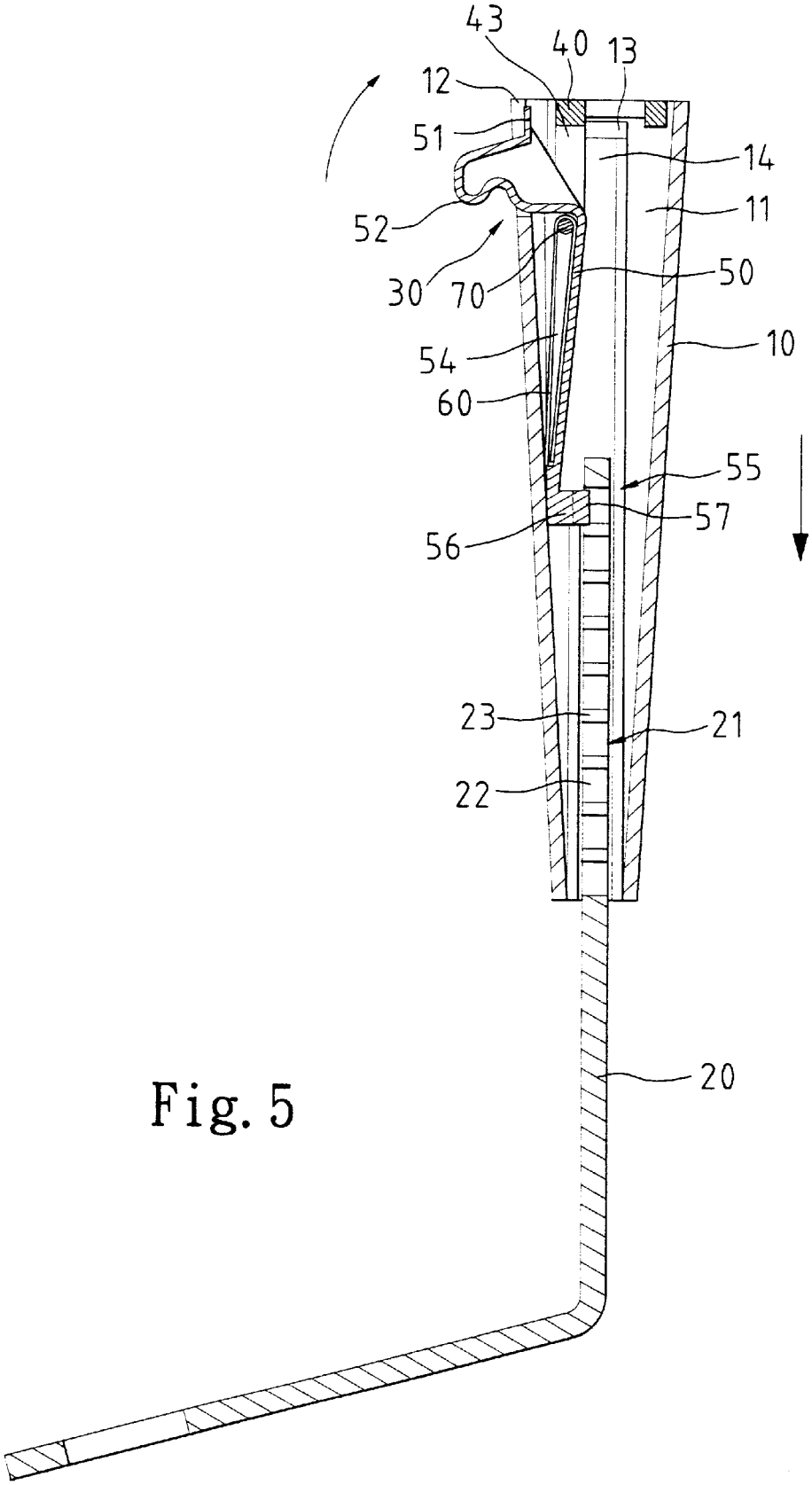
FIG. 5 is a sectional view similar to FIG. 4, wherein the locking means is in a disengaged position allowing adjustment.
Figure 6:
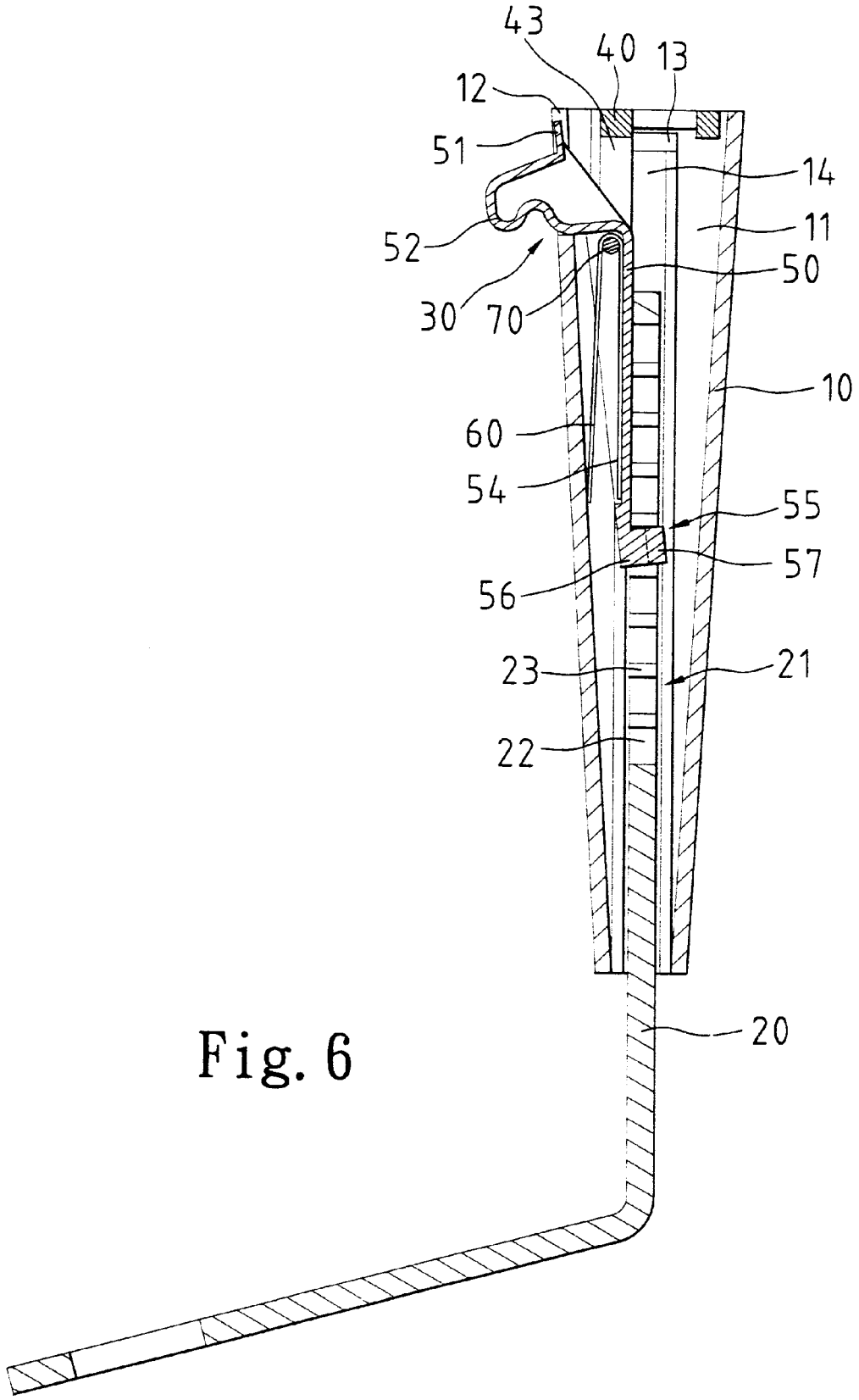
FIG. 6 is a sectional view similar to FIG. 4, wherein the armrest is lowered to a desired level.
Figure 7:
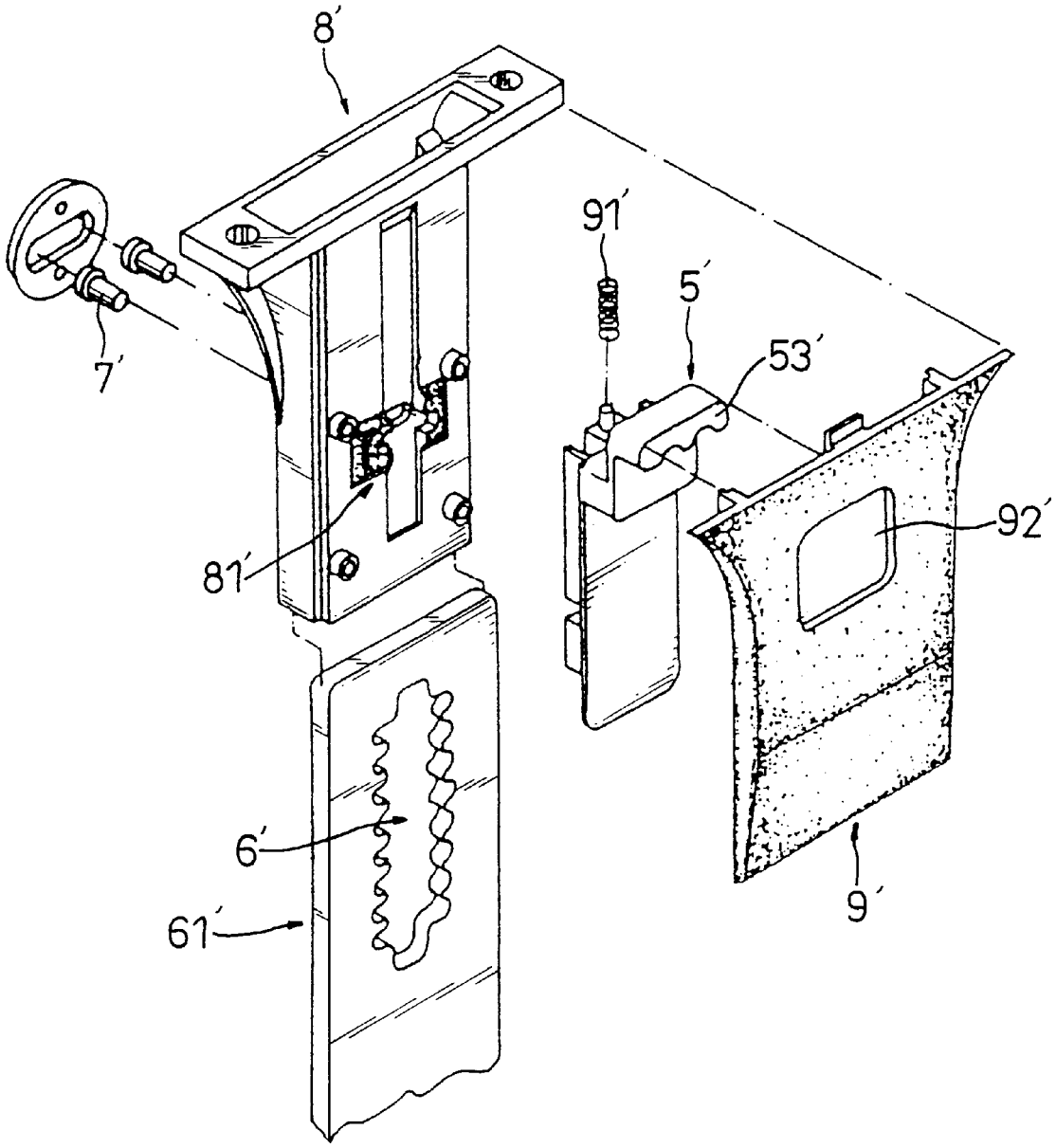
Fig. 7 PRIOR ART
FIG. 7 is an exploded perspective view of a conventional adjustable armrest.
Figure 9:
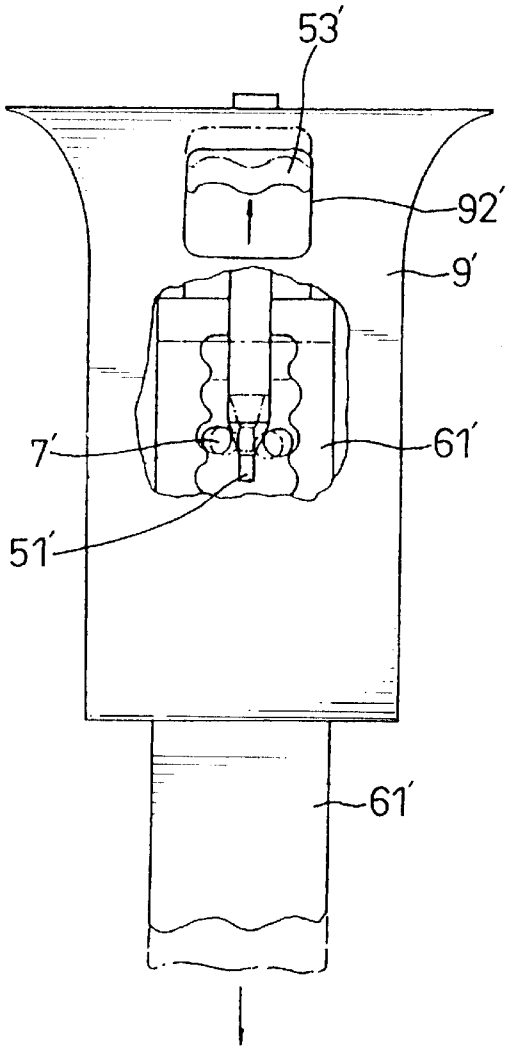
Fig. 9 PRIOR ART
FIG. 9 is a rear view, partly cutaway, of the conventional adjustable armrest in FIG. 7.
Figure 8:
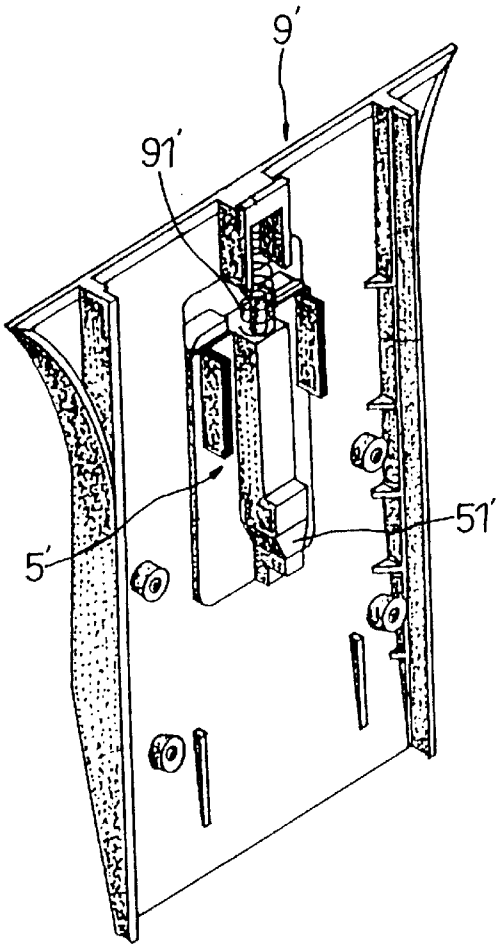
Fig. 8 PRIOR ART
FIG. 8 is a perspective view of a cover plate and an actuating member of the conventional adjustable armrest in FIG. 7.

When adjustment is required, the operative member 52 is moved clockwise (FIG. 5) upward such that the locking means 50 is moved away from the positioning member 20 and compresses the elastic member 60, best shown in FIG. 5. In this case, the relatively larger section 56 of the locking means 50 disengages from the retaining hole 22 and the relatively smaller section 57 is moved into the vertical slot 21. The relatively smaller section 57 is passable through the reduced neck sections 23 of the vertical slot 21. Thus, the user may push the armrest main body 10 downward (or lift it upward) to a desired level, and then release the armrest main body 10 such that the relatively larger section 56 of the locking means 50 reengages with the selected one of the retaining holes 22 under the action of the elastic member 60. Thus, the armrest main body 10 is retained at the desired level under the reliable engaging effect between the relatively larger section 56 of the locking means 50 and the associated retaining hole 22.

Although the invention has been explained in relation to its preferred embodiment, it is to be understood that many other possible modifications and variations can be made without departing from the spirit and scope of the invention as hereinafter claimed.

What is claimed is:

1. An adjustable armrest assembly comprising, in combination:

an armrest main body having a compartment therein;

a positioning member having an end slideably received in the compartment, the end of the positioning member including a vertical slot;

a locking means pivotally connected to the armrest main body about a screw, the locking means including an operative member exposed outside the armrest main body for manual operation, the locking means being releasably engaged in the vertical slot for retaining the positioning member in a desired level; and an elastic member of a V-shape and including a bend section intermediate a first end and a second end, with the first end bearing against the locking means and the second end bearing against the armrest main body, with the screw extending below the bend section of the elastic member.

2. The adjustable armrest assembly as claimed in claim 1, wherein the vertical slot includes a plurality of consecutively connected vertical retaining holes, two adjacent said retaining holes having a reduced neck portion therebetween, and wherein the locking means includes a locking member having a relatively larger section and a relatively smaller section, the relatively larger section being larger than the reduced neck portion and sized to be received in one of the retaining holes, the relatively smaller section being sized to be passable through the reduced neck portion.

3. The adjustable armrest assembly as claimed in claim 2, wherein the elastic member biases the relatively larger section of the locking member to engage with said one of the retaining holes, thereby retaining the armrest main body at a desired level relative to the positioning member.

4. The adjustable armrest assembly as claimed in claim 2, wherein the armrest main body includes a vertical groove on each of two lateral walls thereof for slidably holding the end of the positioning member.

5. An adjustable armrest assembly comprising, in combination:

an armrest main body having a compartment therein;

a positioning member having an end slideably received in the compartment, the end of the positioning member including a vertical slot;

a locking means pivotally connected to the armrest main body, the locking means including an operative member exposed outside the armrest main body for manual operation, the locking means being releasably engaged in the vertical groove for retaining the positioning member in a desired level; and a top plate secured on top of the armrest main body, the locking means being in pivotal connection with the top plate such that the locking means is moved to disengage from the vertical slot when the operative member is manually operated.

6. The adjustable armrest assembly as claimed in claim 5, wherein the vertical slot includes a plurality of consecutively connected vertical retaining holes, two adjacent said retaining holes having a reduced neck portion therebetween, and wherein the locking means includes a locking member having a relatively larger section and a relatively smaller section, the relatively larger section being larger than the reduced neck portion and sized to be received in one of the retaining holes, the relatively smaller section being sized to be passable through the reduced neck portion.

7. The adjustable armrest assembly as claimed in claim 6, wherein the armrest main body includes a vertical groove on each of two lateral walls thereof for slideably holding the end of the positioning member.

8. The adjustable armrest assembly as claimed in claim 5, wherein the armrest main body includes a vertical groove on each of two lateral walls thereof for slideably holding the end of the positioning member.

9. The adjustable armrest assembly as claimed in claim 6, further comprising an elastic member having a first end attached to the locking means and a second end attached to the armrest main body for biasing the relatively larger section of the locking member to engage with said one of the retaining holes, thereby retaining the armrest main body at a desired level relative to the positioning member.

10. The adjustable armrest assembly as claimed in claim 9, wherein the locking means includes a transverse hole through which a screw extends, thereby providing a pivotal connection with the locking means and the top plate, and wherein the locking means includes a recessed section communicated with the transverse hole, the elastic member being V-shape with a bend section and received in the recessed section of the locking means, the screw being extended below the bend section of the elastic member.

11. The adjustable armrest assembly as claimed in claim 1, wherein the locking means includes a recessed section, with the first end of the elastic member being received in the recessed section.

12. The adjustable armrest assembly as claimed in claim 11, further comprising, in combination: a top plate secured on top of the armrest main body, the locking means being in pivotal connection with the top plate such that the locking means is moved to disengage from the vertical slot when the operative member is manually operated.

13. The adjustable armrest assembly as claimed in claim 12, wherein the vertical slot includes a plurality of consecutively connected vertical retaining holes, two adjacent said retaining holes having a reduced neck portion therebetween, and wherein the locking means includes a locking member having a relatively larger section and a relatively smaller section, the relatively larger section being larger than the reduced neck portion and sized to be received in one of the retaining holes, the relatively smaller section being sized to be passable through the reduced neck portion.

14. The adjustable armrest assembly as claimed in claim 13, wherein the armrest main body includes a vertical groove on each of two lateral walls thereof for slideably holding the end of the positioning member.

15. The adjustable armrest assembly as claimed in claim 1, further comprising, in combination: a top plate secured on top of the armrest main body, the locking means being in pivotal connection with the top plate such that the locking means is moved to disengage from the vertical slot when the operative member is manually operated.

16. The adjustable armrest assembly as claimed in claim 15, wherein the vertical slot includes a plurality of consecutively connected vertical retaining holes, two adjacent said retaining holes having a reduced neck portion therebetween, and wherein the locking means includes a locking member having a relatively larger section and a relatively smaller section, the relatively larger section being larger than the reduced neck portion and sized to be received in one of the retaining holes, the relatively smaller section being sized to be passable through the reduced neck portion.

17. The adjustable armrest assembly as claimed in claim 1, wherein the armrest main body includes a vertical groove on each of two lateral walls thereof for slideably holding the end of the positioning member.

* * * * *